United States Patent [19]

Noma et al.

[11] Patent Number: 4,738,806

[45] Date of Patent: Apr. 19, 1988

[54] HUMIDIFIER FOR REFRIGERATION SHOWCASE

[75] Inventors: Kouichi Noma, Ota; Kazuto Matsuda, Ora; Tadao Okada, Ota; Toru Sugawara; Yoshihiro Hayashi, both of Ashikaga; Masahiro Nakamura, Ora; Etsuo Inamura, Ota, all of Japan

[73] Assignee: Sanyo Electric Co., Ltd., Japan

[21] Appl. No.: 892,085

[22] Filed: Jul. 30, 1986

[30] Foreign Application Priority Data

| | | | |
|---|---|---|---|
| Aug. 8, 1985 | [JP] | Japan | 60-174678 |
| Mar. 28, 1986 | [JP] | Japan | 61-71584 |
| Mar. 28, 1986 | [JP] | Japan | 61-71585 |
| Mar. 28, 1986 | [JP] | Japan | 61-71586 |
| Mar. 28, 1986 | [JP] | Japan | 61-71587 |

[51] Int. Cl.[4] ..... B01F 3/04

[52] U.S. Cl. ..... 261/81; 261/DIG. 14; 261/DIG. 48; 62/247; 310/317

[58] Field of Search ..... 62/247; 261/DIG. 14, 261/DIG. 48, 81; 310/317

[56] References Cited

U.S. PATENT DOCUMENTS

| | | | |
|---|---|---|---|
| 2,243,958 | 6/1941 | Hermann | 62/247 |
| 2,453,595 | 11/1948 | Rosenthal | 261/DIG. 48 |
| 2,891,176 | 6/1959 | Branson | 310/317 |
| 3,469,785 | 9/1969 | Boucher et al. | 261/DIG. 48 |
| 3,561,444 | 2/1971 | Boucher | 261/DIG. 48 |
| 3,585,405 | 6/1971 | Stettiner | 310/317 |
| 3,690,317 | 9/1972 | Millman | 261/DIG. 48 |
| 3,872,470 | 3/1975 | Hoerz et al. | 310/317 |
| 3,933,006 | 1/1976 | South | 62/247 |
| 3,989,042 | 11/1976 | Mitsui et al. | 261/DIG. 48 |
| 4,338,576 | 7/1982 | Takahashi et al. | 331/67 |
| 4,554,477 | 11/1985 | Ratcliff | 310/317 |
| 4,612,777 | 9/1986 | Noma et al. | 261/DIG. 48 |

FOREIGN PATENT DOCUMENTS

| | | | |
|---|---|---|---|
| 35-29579 | 2/1960 | Japan . | |
| 52-9962 | 1/1977 | Japan | 261/DIG. 48 |

*Primary Examiner*—Tim Miles

*Attorney, Agent, or Firm*—Darby & Darby

[57] ABSTRACT

The present invention provides a humidifier for a refrigeration showcase comprising a plurality of ultrasonic vibrators for atomizing water, ultrasonic oscillation circuits provided for the vibrators respectively in corresponding relation thereto, and control means for varying the oscillation output of the oscillation circuit corresponding to at least one of the vibrators to control the amount of atomized water to be produced.

8 Claims, 15 Drawing Sheets

HUMIDIFIER FOR REFRIGERATION SHOWCASE

BACKGROUND OF THE INVENTION

1. Field of the Invention

The present invention relates to a humidifier for humidifying the interior of a refrigeration showcase for preserving and displaying fresh foods, such as vegetables and fruits, for a prolonged period of time.

2. Description of the Prior Art

Unexamined Japanese Patent Publication SHO No. 60-29579, for example, discloses a humidifier for this type of refrigeration showcases which is adapted to supply atomized water to the interior of the showcase at a constant rate. However, when the humidifier was actually used for refrigeration showcases, we found that the following problems still remained to be solved.

(1) The conventional humidifier causes excessive humidification when used for showcases of small size or insufficient humidification when used for showcases of large size.

(2) The commodities to be displayed in showcases include those to be given a large amount of moisture, those requiring only a small amount of moisture and those to be given no moisture whereas the conventional humidifier has difficulty in providing varying amounts of moisture as required.

(3) When one showcase is to display commodities requiring a large amount of humidification, those necessitating only a small amount of humidification and those needing no humidification at the same time, it is difficult to use the conventional humidifier for the showcase.

As far as the present inventors are aware, none of the prior-art devices solve these problems.

SUMMARY OF THE INVENTION

The main object of the present invention is to solve all of the foregoing problems and to provide a humidifier which is freely controllable in the amount of humidification as required during use and which is nevertheless usable in the same manner as conventional humidifiers when such control is not needed.

More specifically, the present invention provides a humidifier for a refrigeration showcase comprising a main body to be fixedly mounted on the top of the showcase, an atomization water tank provided within the main body and having a plurality of ultrasonic vibrators at its bottom, a blower disposed within the main body for drawing in outside air through an intake opening in the main body and supplying the air to the interior of the water tank, ultrasonic oscillation circuits provided for the vibrators respectively in corresponding relation thereto, a plurality of discharge guide tubes rotatably mounted on a member located on the upper portion of the water tank and provided in corresponding relation to the vibrators for guiding out of the main body atomized water produced in the water tank by the vibrator driven by the corresponding oscillation circuit, ducts provided for the guide tubes respectively and each having one end communicating with the guide tube and the other end extending into the showcase, and control means for varying the oscillation output of the oscillation circuit corresponding to at least one of the vibrators to control the amount of atomized water to be produced.

Preferably, the control means includes variable resistor means, whereby the amount of humidification of the showcase is continuously adjustable as desired.

When the variable resistor means is a variable multiple resistor capable of simultaneously varying the oscillation outputs of the plurality of oscillation circuits, the amount of humidification of the showcase is adjustable uniformly, entirely and easily by the resistor.

When the variable resistor means comprises a plurality of variable resistors capable of varying the oscillation outputs of the plurality of oscillation circuits individually, the amount of humidification of the showcase is adjustable locally. This makes it possible for the single showcase to display different kinds of articles which are different in the amount of humidification required.

When the oscillation circuit is provided with a switch for deenergizing the corresponding vibrator, humidification of the showcase can be discontinued locally at the portion thereof necessitating no humidification. This makes it possible for the showcase to display articles for which no humidification is needed.

When the humidifier is provided with selection means for selecting whether the amount of humidification is to be variable or constant, it is possible to selectively operate the control means according to the effect to be expected. It is then possible to use the showcase with the entire interior thereof held under a constant humidified condition and also to humidify the showcase to a variable level as required. This gives improved usefulness to the showcase.

When the control means is removably connected to the main body, with the selection means provided on the main body, the showcase is usable with the control means removed from the main body if there is no need to adjust the amount of humidification. This renders the showcase simple in construction and easy to handle.

A known vibrator such as a piezoelectric vibrator is used as the vibrator, while a known circuit for driving such vibrators is used as the oscillation circuit (see, for example, U.S. Pat. No. 4,338,576).

DESCRIPTION OF THE PREFERRED EMBODIMENTS

A first embodiment of the present invention will be described in detail with reference to FIGS. 1 to 8.

Figure 1:
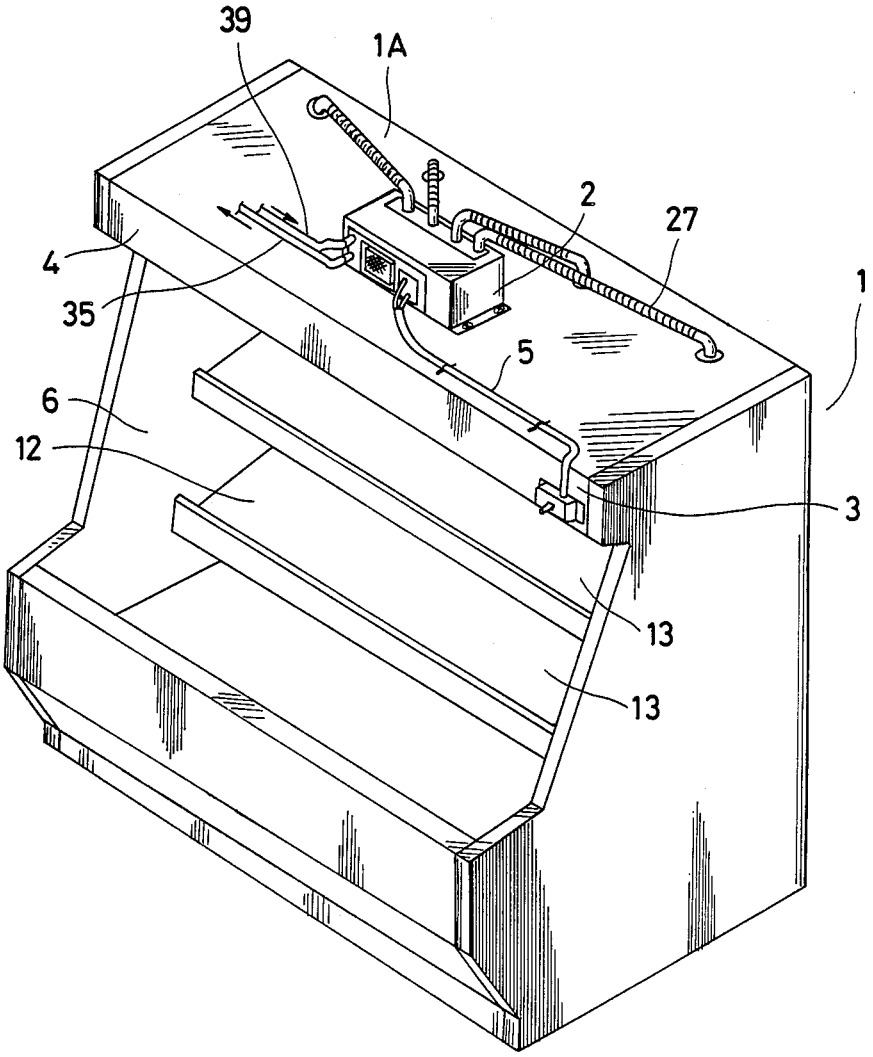
FIG. 1 is a perspective view showing a refrigeration showcase having a humidifier of the present invention attached thereto.

FIG. 1 shows a refrigeration showcase 1, a humidifier 2 fixedly mounted on the top surface 1A of the showcase 1, and a humidification controller 3 fixed to a reflecting plate 4 at the front side of the top of the showcase 1 and connected to the humidifier 2 by lead wires 5 for adjusting the amount of humidification by remote control. Accordingly, the controller 3 needs to be installed in a readily accessible position and is mounted preferably on the reflecting plate 4 or on a front portion of the top surface 1A.

Figure 2:
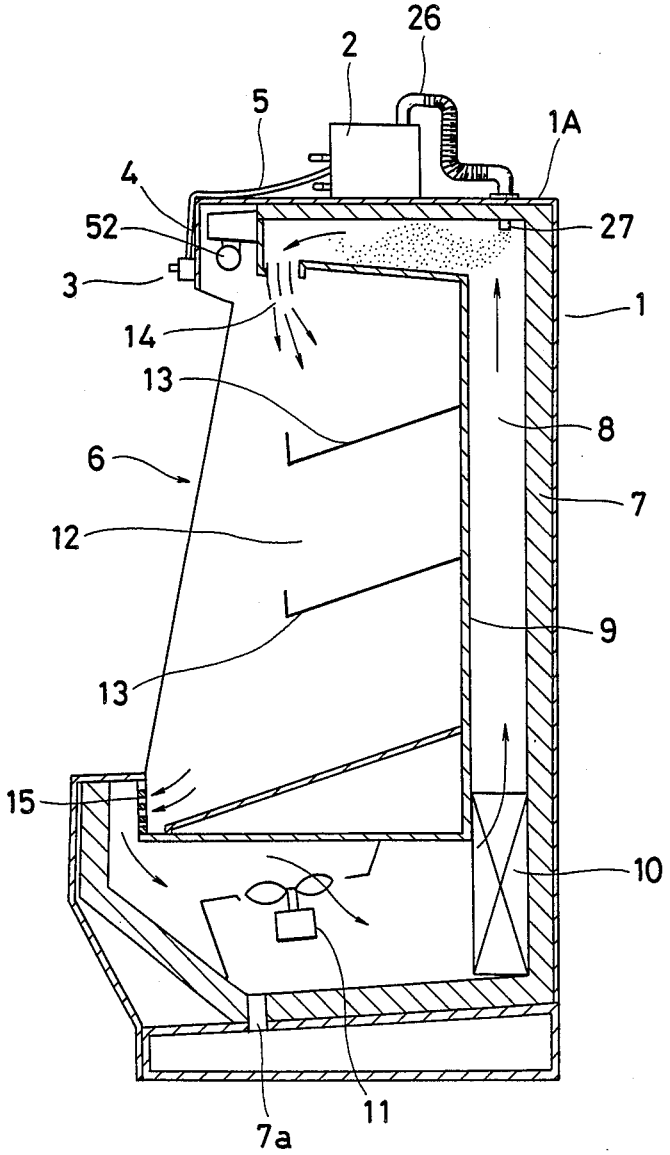
FIG. 2 is a side elevation in vertical section showing the showcase of FIG. 1.

As seen in FIG. 2, the refrigeration showcase 1 has a front opening 6. A cold air passage 8 is defined by the inner surface of a heat insulating wall 7 and a partition plate 9. The cold air passage 8 has a lower space, in which a cooler 10 and a blower 11 are installed. A storage chamber 12 surrounded by the partition plate 9 is provided with racks 13 for displaying vegetables or the like. An air outlet 14 and an air inlet 15 are respectively provided at the upper and lower ends of the opening 6. The air cooled by the cooler 10 is forcedly circulated by the blower 11 as indicated by arrows to form an air curtain across the opening 6 while cooling the interior of the storage chamber 12. A drain 7*a* extends through the heat insulating wall 7 for draining off the water collecting at the bottom of the storage chamber 12.

Figure 3:
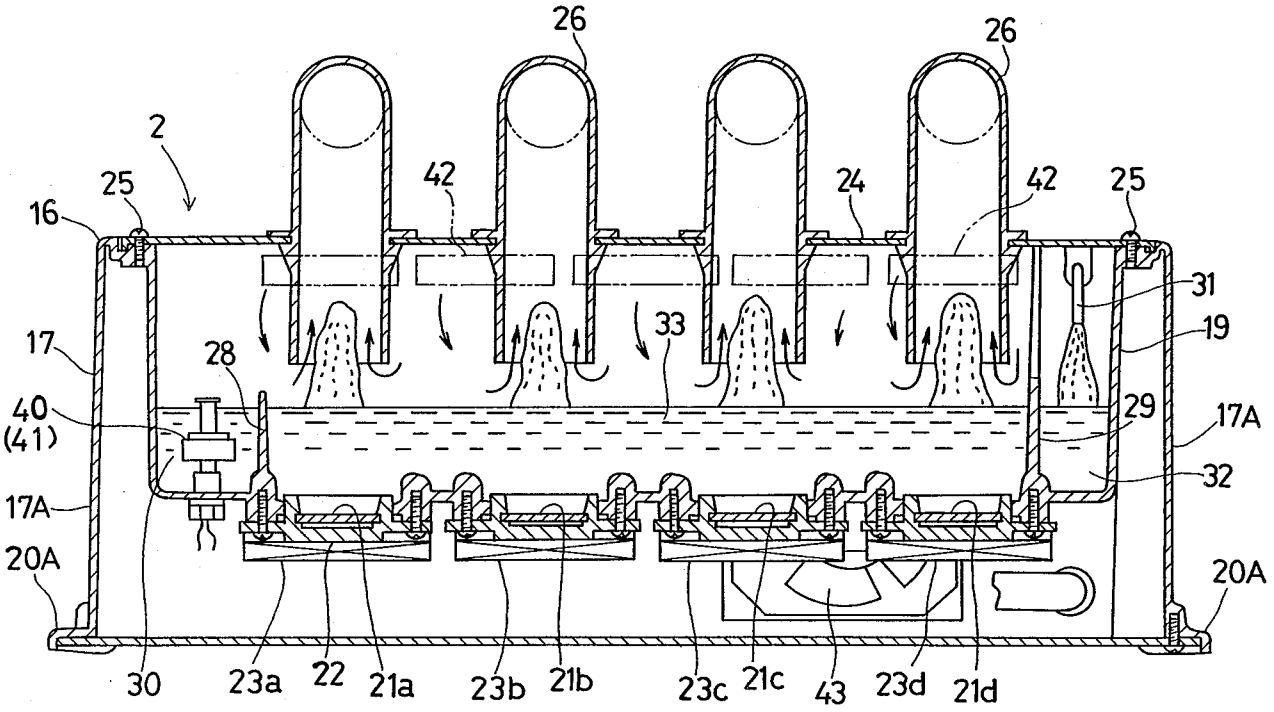
FIG. 3 is a rear view in vertical section showing the humidifier.
Figure 4:
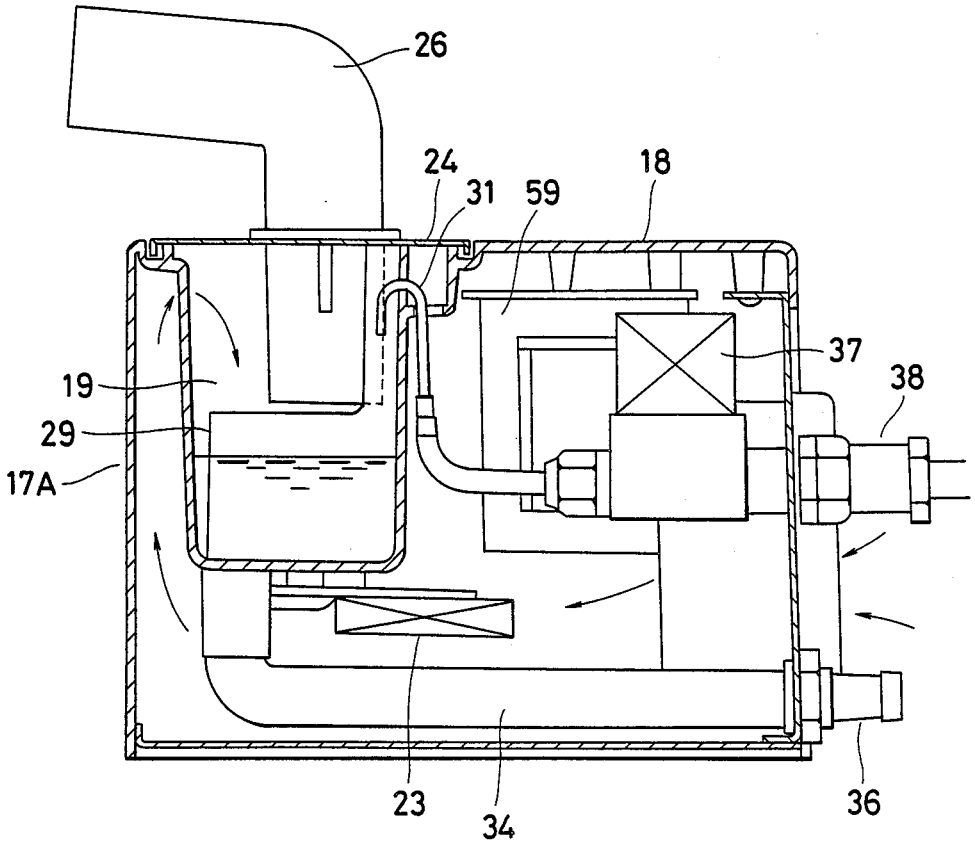
FIG. 4 is a side elevation in vertical section showing the humidifier.
Figure 5:
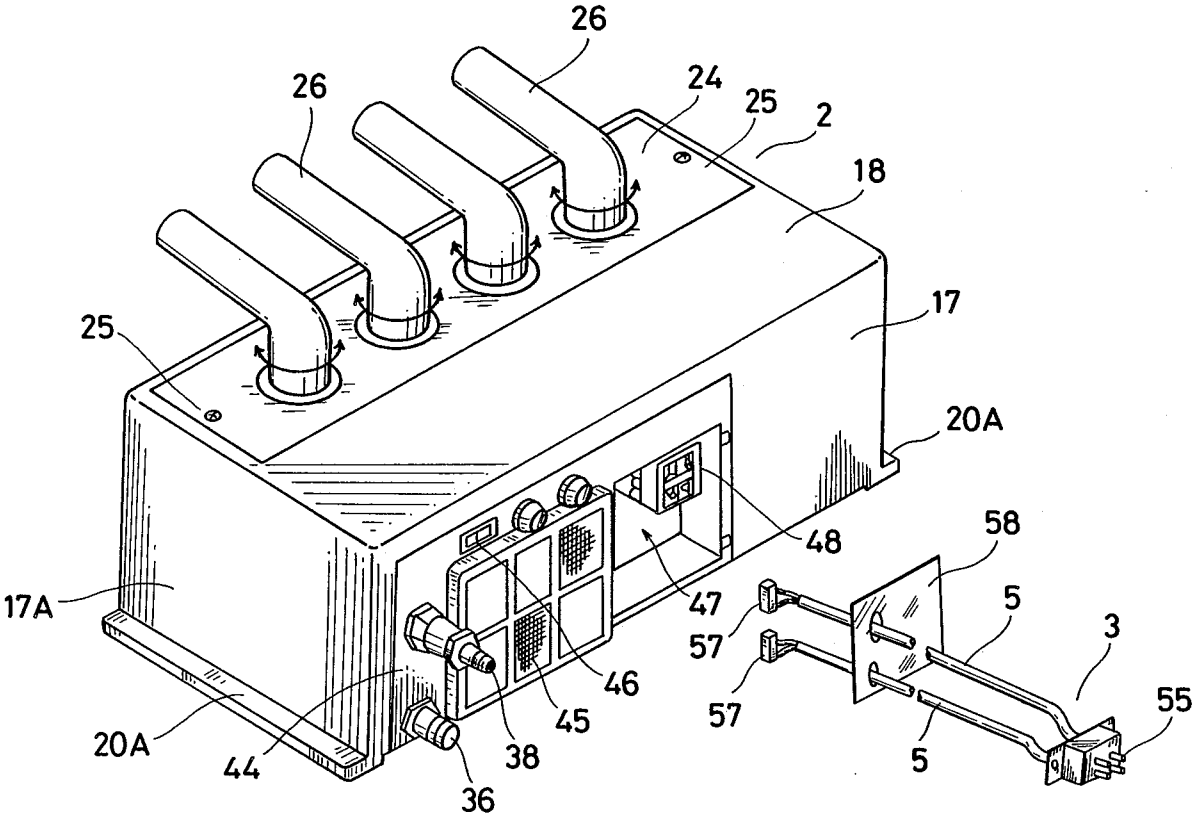
FIG. 5 is a perspective view showing the humidifier.

Next, the humidifier 2 will be described in greater detail with reference to FIGS. 3 to 5. A casing main body 16 comprises a surrounding wall 17, an upper wall 18 and an atomization water tank 19 which are integrally formed from a synthetic resin such as ABS resin or stainless steel. The surrounding wall 17 includes opposite side wall portions 17A, 17A, which are bent sidewise at their lower ends to provide attaching pieces 20A, 20A for fixing the main body 16 to the top surface 1A of the showcase 1 on which the humidifier 2 is mounted. Indicated at 21*a* to 21*d* are a plurality of (four in the present embodiment) ultrasonic vibrators arranged at the bottom of the water tank 19, at 22 are mounts for the vibrators 21*a* to 21*d* and at 23*a* to 23*d* are ultrasonic oscillation circuits for driving the vibrators 21*a* to 21*d*. A stainless steel closure 24 is fastened by screws 25 to the upper wall 18 above the water tank 19 for closing an opening formed in the wall 18. L-shaped discharge guide tubes 26 made of synthetic resin or stainless steel are rotatably supported by the closure 24 and prevented from slipping off. The tubes 26 are respectively provided in corresponding relation to the vibrators 21*a* to 21*d*. With the present embodiment, four guide tubes 26 are provided for the four vibrators 21*a* to 21*d*. Each tube 26 is connected to a communication duct 27 having one end extending into the cold air passage 8.

The guide tubes 26 may be rotatably supported by other members located on an upper portion of the water tank 19, for example, the upper wall 18.

Upright wave confining walls 28 and 29 divide the interior of the atomization water tank 19 into a main water chamber 33 in the middle, and a float chamber 30 and a water supply chamber 32 at opposite sides of the tank 19 and communicating with the main chamber 33 through openings. A water supply pipe 31 extends into the chamber 32. The tank 19 has an overflow pipe 34 connected at a spigot end 36 to a drain pipe 35 for discharging water when the water within the tank 19 exceeds a predetermined level. The water supply pipe 31 is connected to a water supply conduit 39 connectable to a water supply via a water supply electromagnetic valve 37 and a connection 38.

A first float switch 40 disposed in the float chamber 30 detects depletion of water within the water tank 19 by a lowering of a float to deenergize the oscillation circuits 23*a* to 23*d* and preclude the vibrators 21*a* to 21*d* from breaking owing to unloaded vibration. A second float switch 41 (shown in FIG. 7) is similarly disposed within the float chamber 30 beside the first float switch 40 for energizing the water supply valve 37 to supply water to the tank 19 through the pipe 31 when the water within the tank 19 lowers below a given level.

Figure 6:
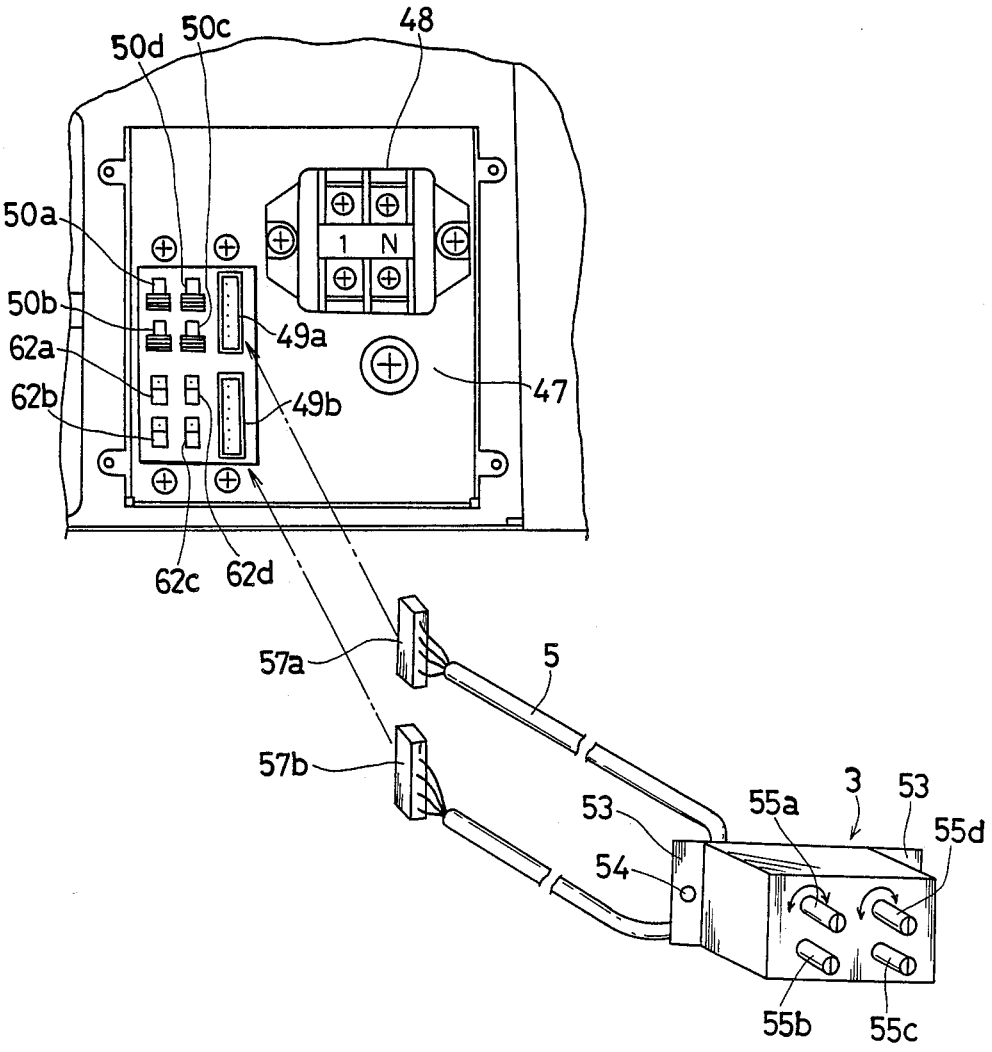
FIG. 6 is a view showing a cavity in the humidifier and a humidification controller.

Air outlet openings 42 are formed in the upper portion of the front wall of the tank 19, in front of which a blower 43 is provided within the casing main body 16. Through these openings 42, air is forced into the tank 19 by the blower 43. In front of the blower 43, the main body 16 has a mount plate 44. An air intake opening provided with a filter 45 is formed in the mount plate 44. Indicated at 46 is a power switch. Adjacent the filter 45, the mount plate 44 has a cavity 47. As seen in FIG. 6, the cavity 47 is provided with a power supply terminal support 48 connectable to a commercial power supply, first connectors A 49*a*, 49*b* and selection knobs 50*a* to 50*d*. When manipulated, the selection knobs 50*a* to 50*d* which are vertically slidable open or close selector switches 51*a* to 51*d* (see FIG. 7) which are provided in corresponding relation to these knobs 50*a* to 50*d*, whereby the amount of humidification to be afforded by the vibrators 21*a* to 21*d* is made adjustable or alternatively, constant. The humidification controller 3 is provided at its opposite sides with lugs 53 having a screw hole 54 for fixing the controller 3 to the reflecting plate 4. A fluorescent lamp 52 is provided behind the plate 4. Control knobs 55*a* to 55*d* are provided for varying the resistance value of variable resistors 56*a* to 56*d*, respectively, which are housed in the casing. When rotated, the knobs 55*a* to 55*d* control the variable resistors 56*a* to 56*d* which are provided for the vibrators 21*a* to 21*d*, respectively, to vary the oscillation output of the oscillation circuits 23*a* to 23*d*. Second connectors B 57*a*, 57*b* connectable to the first connectors A 49*a*, 49*b* are connected to the controller 3 by lead wires 5. When the desired one of the selection knobs 50*a* to 50*d* is manipulated to open the corresponding one of the selector switches 51*a* to 51*d*, with the connectors A and B connected together, the amount of humidification by the corresponding one of the vibrators 21*a* to 21*d* is adjustable by the controller 3. Indicated at 58 is a cover for the cavity 47.

Figure 7:
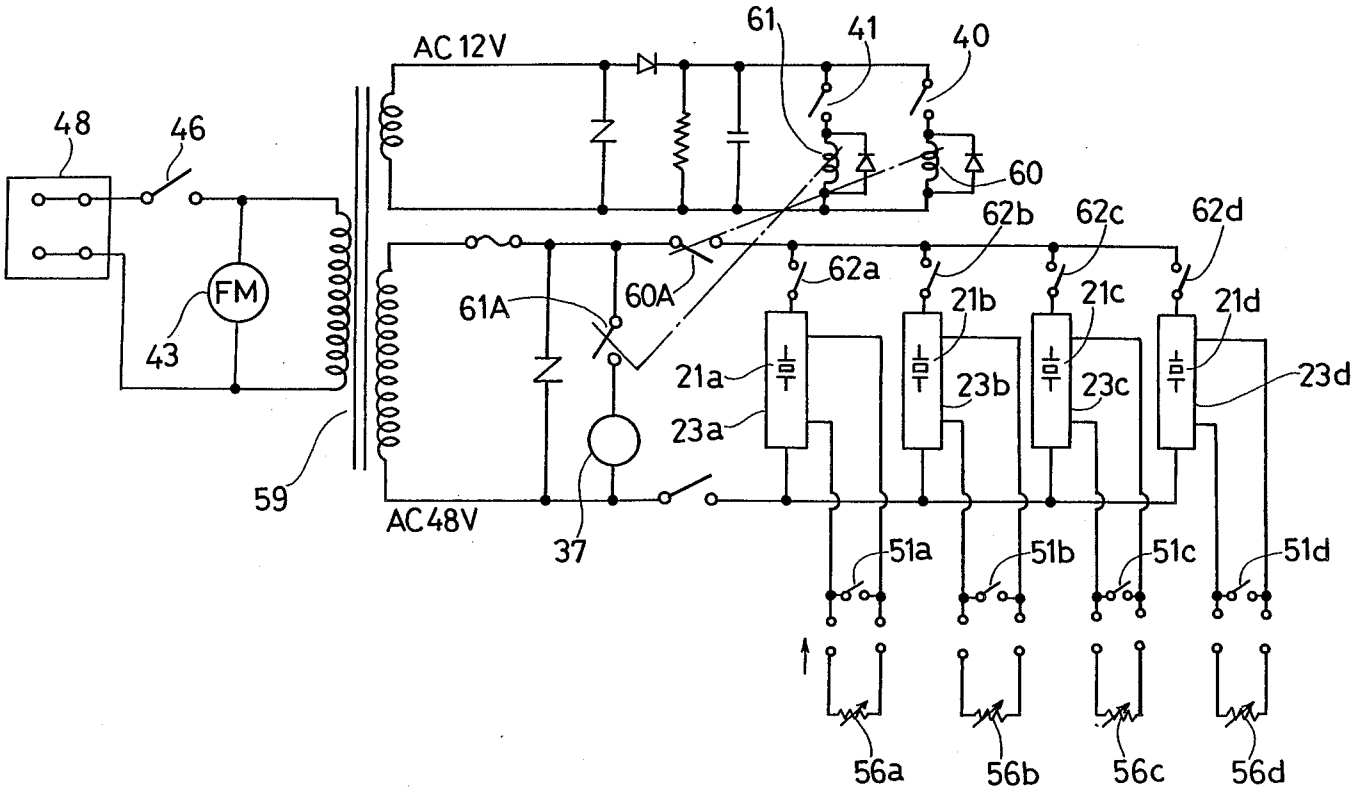
FIG. 7 is a diagram showing the electric circuit of the humidifier.

With reference to FIG. 7, a power source transformer 59 is adapted to give two outputs of different voltages. Indicated at 60 is a relay which is deenergized to open a switch 60A and deenergize the oscillation circuits 23*a* to 23*d*, when the first float switch 40 opens upon the water tank 19 becoming depleted of water. Indicated at 61 is a relay which is energized to close a switch 61A and open the water supply electromagnetic valve 37 by energization, when the second float switch 41 closes upon the water level within the tank 19 lowering to the predetermined level. Control switches 62*a* to 62*d* are provided in the cavity 47 for the vibrators 21*a* to 21*d*, respectively, for controlling the supply of current to the vibrators.

The operation of the humidifier 2 will be described below, first in the case where the humidification controller 3 is not attached to the reflecting plate 4, with the connector B 57*a*, 57*b* not connected to the connector A 49*a*, 49*b*, not to render the amount of humidification adjustable. In this case, the selector switches 51*a* to 51*d* are closed by the manipulation of the selection knobs 50*a* to 50*d* to keep the amount (rate) of humidification constant. First, the power switch 46 is closed with the power supply connected to the power terminal support 48, whereupon the blower 43 and the ultrasonic oscillation circuits 23*a* to 23*d* are initiated into operation. Through the filter 45, outside air is admitted into the space between the bottom of the atomization water tank 19 and the bottom wall of the humidifier 2 and further introduced into the water tank 19 through the openings 42 formed in the tank wall while cooling the transformer 59 and the oscillation circuits 23*a* to 23*d*. At this time, the operation of the vibrators 21*a* to 21*d* produces water columns on the surface of the water. The atomized water formed around the water columns is led out of the humidifier 2 into the cold air passage 8 of the refrigeration showcase 1 via the guide tubes 26 and the communication ducts 27, whereupon the atomized water joins the cold air stream through the cold air passage 8 and is forced out into the storage chamber 12 through the air outlet 14 to give moisture to the vegetables or the like on the racks 13.

When the commodities on the racks 13 include those for which humidification is undesirable or those which have already been fully humidified, humidification of such commodities is discontinued by opening the control switch (62*a*–62*d*) for energizing the oscillation circuit (23*a*–23*d*) for driving the vibrator (21*a*–21*d*) which corresponds to the communication duct 27 for humidifying these commodities. Thus, the desired vibrator or vibrators can be controlled to humidify, or interrupt humidification of, the commodities displayed on the racks 13, or not to humidify them from the beginning.

Figure 8:
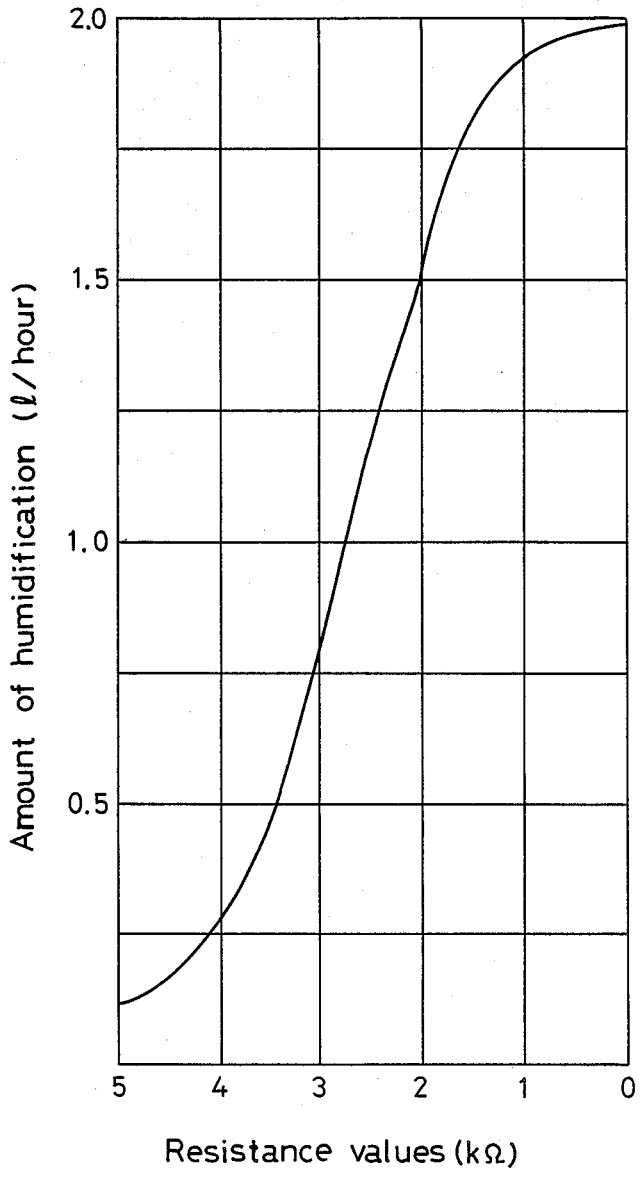
FIG. 8 is a graph showing the relation between the amount of humidification and the resistance value of a variable resistor included in the humidification controller.

The humidifier 2 can be operated in another mode by attaching the humidification controller 3 to the reflecting plate 4 at the front side of the top of the showcase 1 by the lugs 53 and screws, connecting the connectors B 57*a*, 57*b* to the connectors A 49*a*, 49*b* and manipulating the selection knobs 50*a* to 50*d* to open the selector switches 51*a* to 51*d* and connect the variable resistors 56*a* to 56*d* to the oscillation circuits 23*a* to 23*d*, respectively. The amount of humidification is then adjustable. When one of the selection knobs 50*a* to 50*d*, e.g. knob 50*a*, is manipulated to open the corresponding selector switch 51*a* the oscillation output of the oscillation circuit 23*a* is variable by the corresponding variable resistor 56*a*. This makes it possible to adjust the amount of humidification to be afforded by the vibrator 21*a* corresponding to the manipulated knob 50*a*. Thus, humidification is controllable locally by rotating the control knob 55*a*. While the variable resistors 56*a* to 56*d* of the present embodiment have a maximum resistance value of 5 kΩ, FIG. 8 shows variations in the amount (rate) of humidification by one vibrator 21 at varying resistance values of the variable resistor, as determined at a water temperature of 18° C.

Accordingly, depending on the kind of commodities on the racks 13 of the showcase 1 and also on the location of a particular kind of commodities, selection is made as to whether the amount of humidification by the vibrators 21*a* to 21*d* is to be contant or adjustable.

When the commodities on the racks 13 include those for which no humidification is desirable or those which have already been fully humidified as stated above, the desired control switch (62*a*–62*d*) is opened to break the current passing circuit for the desired vibrator (21*a*–21*d*) and oscillation circuit (23*a*–23*d*).

With the present invention described above, the passage of current through the ultrasonic vibrator(s) is controllable for the commodities for which humidification is not desirable or is to be discontinued, in accordance with the kind of commodities on the racks of the refrigeration showcase and with the location of a particular kind of commodities. The invention further makes it possible to display in a single refrigeration showcase commodities for which humidification is not desirable and those which are to be humidified at a higher rate or lower rate and to locally control humidification in accordance with the type of commodities.

Figure 9:
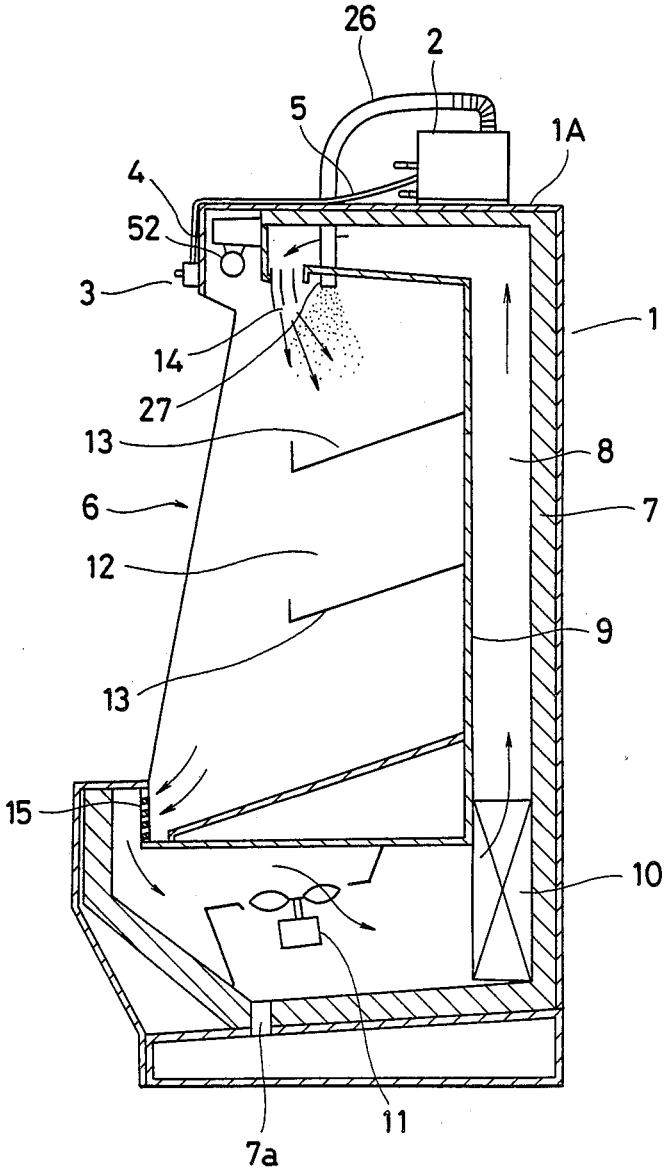
FIGS. 9 and 10 are views corresponding to FIG. 2 and showing the humidifier as modified in the mode of its communication with the showcase.

As shown in FIG. 9, the communication ducts 27 for guiding the atomized water from the humidifier 2 into the showcase 1 via the guide tubes 26 can be provided across the cold air passage 8 to cause the atomized water to flow along the inner side of the air curtain.

Figure 10:
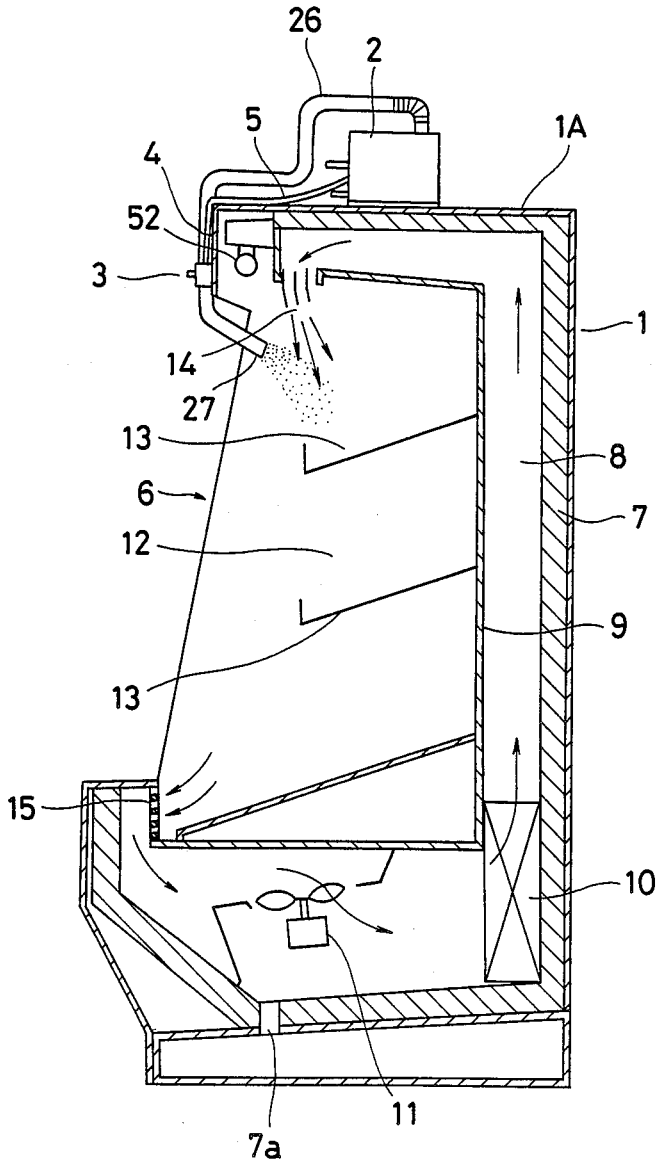

Alternatively, the communication ducts 27 may be positioned at the upper portion of the front opening 6 of the showcase 1 as seen in FIG. 10 to force the atomized water to flow into the showcase along the inner side of the air curtain.

Figure 11A:
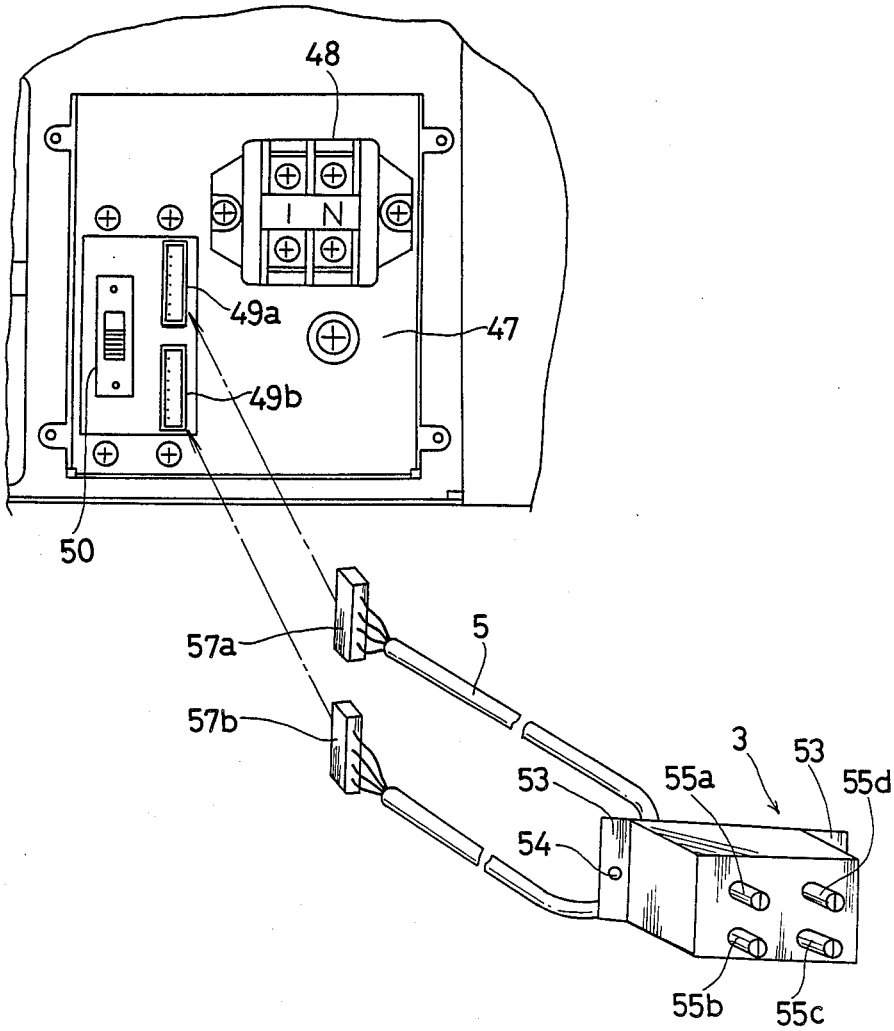
FIGS. 11A and 11B are views corresponding to FIGS. 6 and 7, respectively, and showing a second embodiment of the present invention.
Figure 11B:
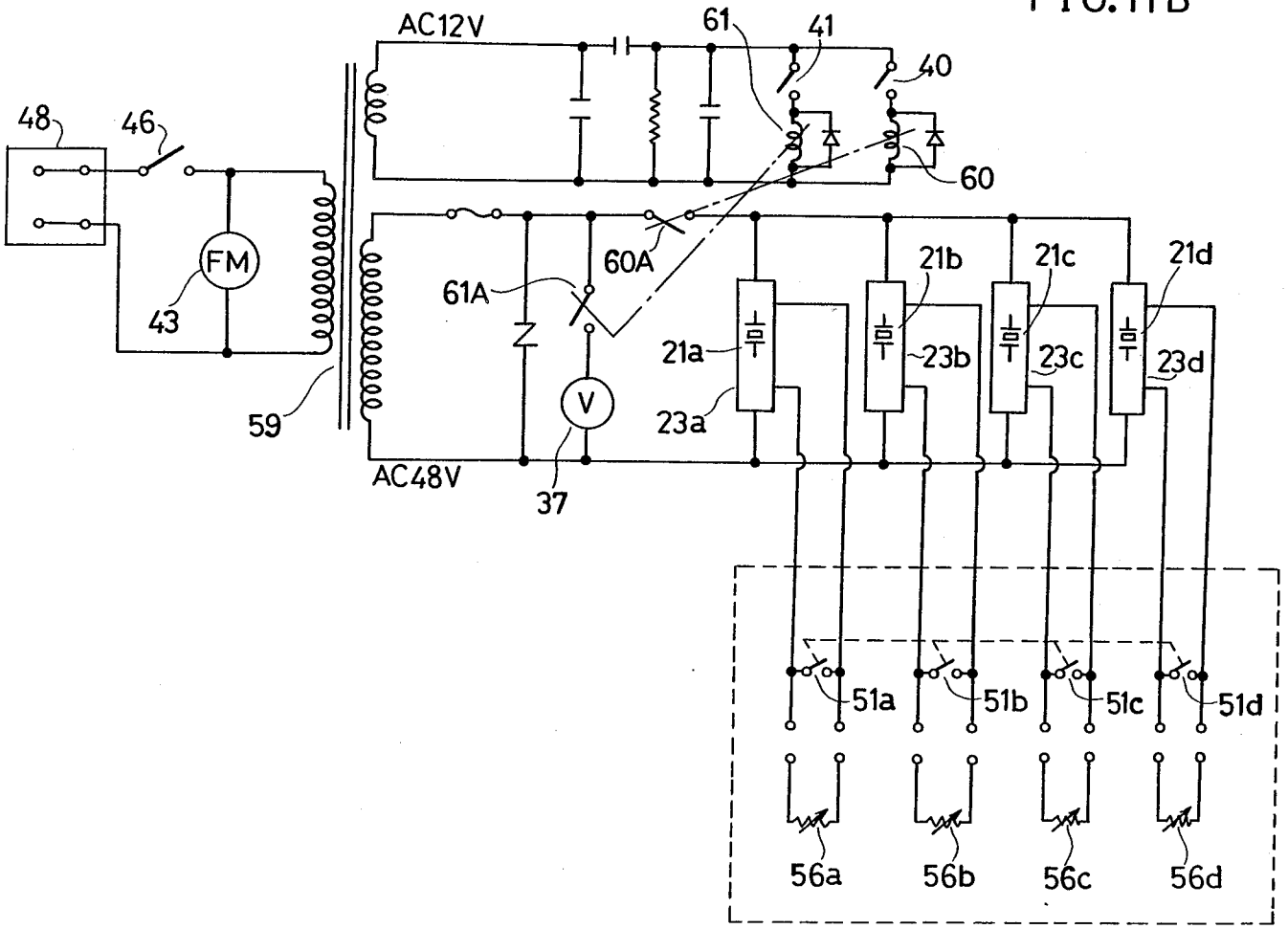

FIGS. 11A and 11B, corresponding to FIGS. 6 and 7 respectively, show a second preferred embodiment of the present invention.

The second embodiment differs from the first embodiment in that the selection knobs 50*a* to 50*d* of the first embodiment are collectively provided as a single selection knob 50 in the second embodiment to thereby open or close the four selector switches 51*a* to 51*d* at the same time.

The second embodiment further differs from the first in that the control switches 62*a* to 62*d* of the first embodiment are omitted from the second, the contacts of these switches being electrically short-circuited.

The operation of the second embodiment will be described below. First, in the case where the connectors B 57*a*, 57*b* are not connected to the connectors A 49*a*, 49*b*, i.e., in the case where the amount of humidification is not made controllable, the selection knob 50 is manipulated to hold all the selector switches 51*a* to 51*d* closed at the same time. When the power switch 46 is closed with the power supply connected to the power terminals 48, the blower 43 and the ultrasonic oscillation circuits 23*a* to 23*d* are initiated into operation, and these circuits produce the same output. The atomized water consequently produced is guided from the humidifier 2 into the cold air passage 8 of the showcase 1 through all the guide tubes 26 and communication ducts 27. The atomized water joins the cold air stream through the passage 8 and is forced out from the air outlet 14 into the storage chamber 12 to humidify vegetables or the like on the racks 13.

Next, when the selection knob 50 is manipulated with the connectors B 57*a*, 57*b* connected to the connectors A 49*a*, 49*b*, the selector switches 51*a* to 51*d* are opened thereby at the same time. Consequently, the oscillation output of each of the oscillation circuits 23*a* to 23*d* is variable by altering the resistance value of the corresponding one of the variable resistors 56*a* to 56*d*. Therefore, when the desired one of control knobs 55*a* to 55*d* is manipulated, the amount of humidification by the corresponding vibrator (21*a*–21*d*) is adjustable. When different kinds of vegetables are placed on the racks 13 of the showcase 1 dividedly at different locations, and the amounts of humidification by the vibrators 21*a* to 21*d* for humidifying the vegetables through the communication ducts 27 are individually adjusted, the displayed vegetables can be humidified suitably according to the kind.

Figure 12A:
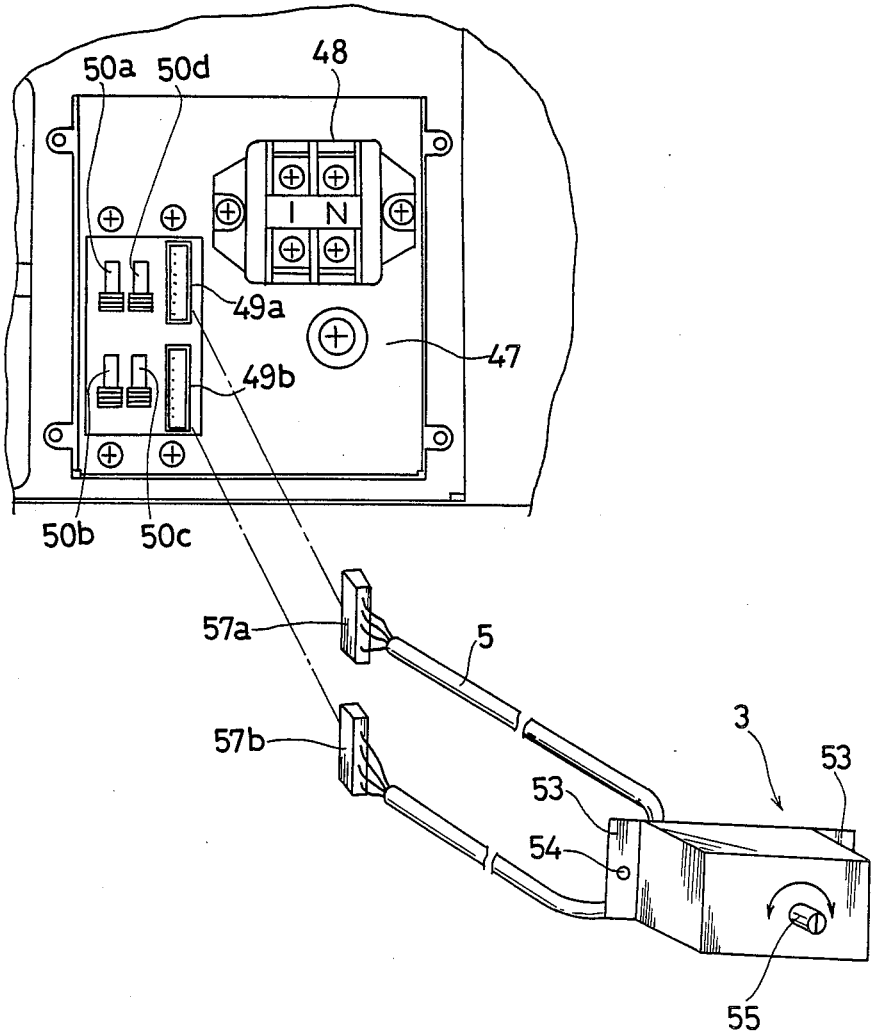
FIGS. 12A and 12B are a view corresponding to FIG. 6 and a fragmentary electric circuit diagram, respectively, of a third embodiment of the invention.
Figure 12B:
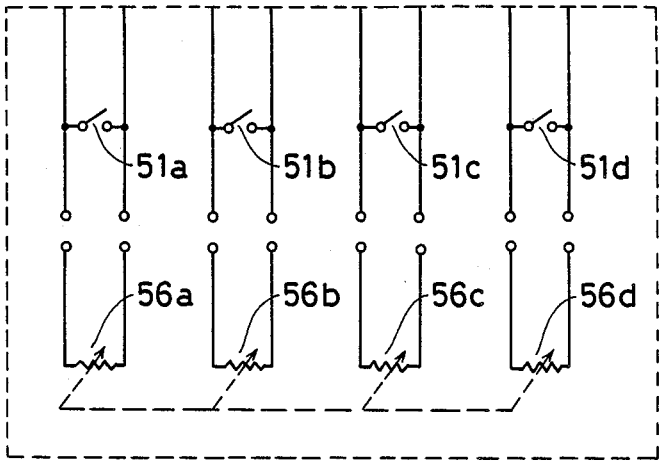

FIGS. 12A and 12B show a third preferred embodiment of the present invention.

The third embodiment differs from the second in that the circuit portion surrounded by a broken line in FIG. 11B is modified as shown in FIG. 12B. More specifically, the second embodiment has the single collective selection knob 50, whereas the control knobs 55*a* to 55*d* of the second embodiment are collectively provided as a single control knob 55 according to the third embodiment, whereby the four variable resistors 56*a* to 56*d* are made adjustable at the same time in operative relation therewith.

The operation of the third embodiment will be described below.

In the case where the connectors B 57*a*, 57*b* are not connected to the connectors A 49*a*, 49*b*, the selection knobs 50*a* to 50*d* are manipulated to close all the selector switches 51*a* to 51*d*. The oscillation circuits 23*a* to 23*d* then operate to give the same output and thereby humidify all the commodities on the racks 13 of the showcase uniformly.

Next, when the connectors 57*a*, 57*b* are connected to the connectors A 49*a*, 49*b*, desired selection knob or knobs (50*a*–50*d*) are manipulated, whereby the corresponding selector switch or switches (51*a*–51*d*) are closed. The oscillation output of the corresponding oscillation circuit(s) is then adjustable by the corresponding variable resistor(s) (56*a*–56*d*), with the output of the other circuits maintained at a constant level. Accordingly, when it is desired to adjust the amount of humidification of the showcase 1 at a specified location of storage, the variable resistor corresponding to this location is made adjustable by the corresponding selection knob (50*a*–50*d*).

Figure 13A:
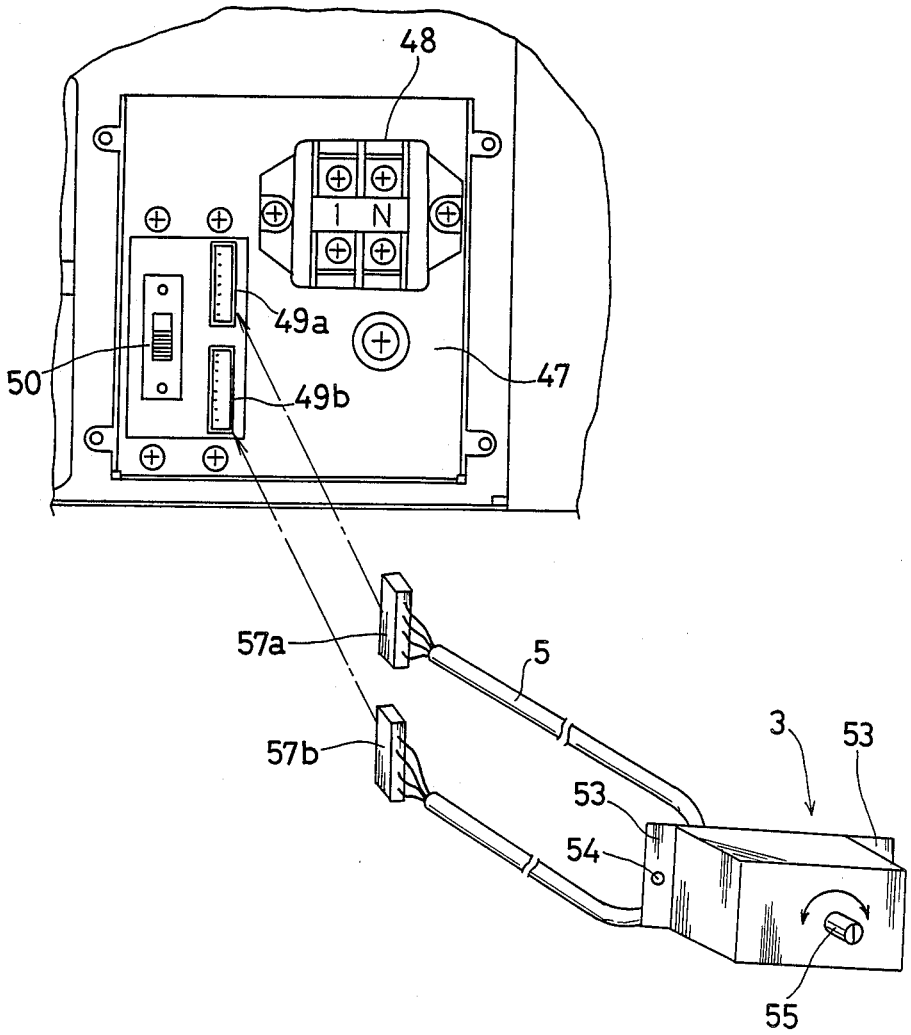
FIGS. 13A and 13B are a view corresponding to FIG. 6 and a fragmentary electric circuit diagram, respectively, of a fourth embodiment of the invention. De
Figure 13B:
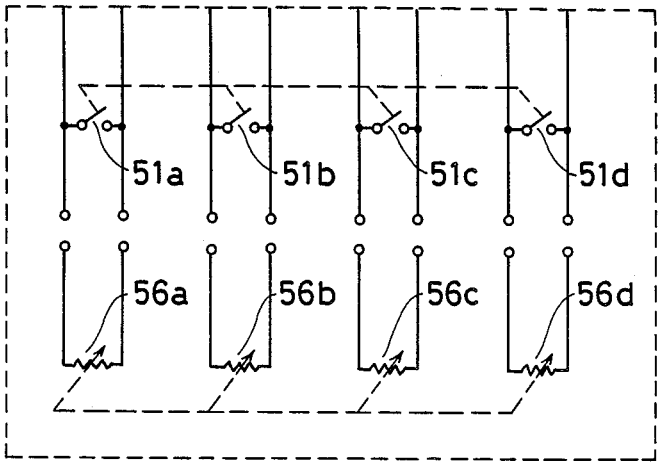

FIGS. 13A and 13B show a fourth preferred embodiment of the present invention.

The fourth embodiment differs from the third in that the circuit portion shown in FIG. 12B is modified as shown in FIG. 13B. More specifically stated, the selection knobs 50*a* to 50*d* of the third embodiment are collectively provided as a single selection knob 50 in the fourth embodiment, whereby the four selector switches 51*a* to 51*d* are made openable or closable at the same time in operative relation with the knob 50.

The operation of the fourth embodiment will be described below. When the connectors B 57*a*, 57*b* are not connected to the connectors A 49*a*, 49*b*, the selection knob 50 is manipulated to close all the selector switches 51*a* to 51*b*, permitting all the oscillation circuits 23*a* to 23*d* to operate to give the same output. Consequently, the commodities on the racks 13 in the showcase 1 are all humidified uniformly.

In the case where the connectors B 57*a*, 57*b* are connected to the connectors A 49*a*, 49*b*, the selection knob 50 is manipulated to open the selector switches 51*a* to 51*d*, whereby the oscillation outputs of all the circuits 23*a* to 23*d* are made simultaneously adjustable by the control knob 55. This enables the user to vary the amount of humidification while observing the condition of vegetables or the like. Since the outputs of the oscillation circuits 23*a* to 23*d* are variable at the same time by a single action to set the amount of humidification to a proper value easily and uniformly in aocordance with the size of the showcase and the kind and quantity of commodities on display, the humidifier is very convenient to handle.

Although the humidification controller 3 is made removably connectable to the casing main body 16 by the connectors A 49*a*, 49*b* and the connectors B 57*a*, 57*b* according to the foregoing embodiments, the controller 3 may alternatively be held connected to the casing main body 16. In this case, however, it is desirable that the controller 3 be provided with connecting lines, such as lead wires 5, for remote control.

When the variable resistors 56*a* to 56*d* are those wherein the resistance value is variable from 0 Ω, the selection knobs 50*a* to 50*d* and the selector switches 51*a* to 51*d* can be dispensed with, and nevertheless, the showcase can be humidified selectively at a constant rate or at a variable rate. More specifically, if the resistors 56*a* to 56*d* are set to a resistance value of 0 Ω, the humidifier is in the same condition as when the selector switches 51*a* to 51*d* are closed, i.e., in condition to give a constant amount of humidification. Further if the variable resistors 56*a* to 56*d* are set to a value over 0 Ω, the same condition as when the selector switches 51*a* to 51*d* are open is realized to provide a variable amount of humidification.

Although the variable resistors 56*a* to 56*d* are provided for all the oscillation circuits 23*a* to 23*d*, respectively, according to the embodiments described, the variable resistor may be provided for at least one of the oscillation circuits 23*a* to 23*d*, such that these circuits are divided into one group for constant-rate humidification and the other group for humidification at a variable rate. When so designed, the humidifier is usable for a showcase for displaying foods which are different in the amount of humidification needed. If the variable resistor used in this case is adjustable from 0 Ω, it is possible to operate all the oscillation circuits 23*a* to 23*d* at a constant output when the resistance value is set to 0 Ω, and to omit the selection knobs and selector switches.

What is claimed is:

1. A humidifier for a refrigeration showcase comprising a main body to be fixedly mounted on the top of the showcase, an atomization water tank provided within the main body and having a plurality of ultrasonic vibrators at its bottom, a blower disposed within the main body for drawing in outside air through an intake opening in the main body and supplying the air to the interior of the water tank, ultrasonic oscillation circuits provided for the vibrators respectively in corresponding relation thereto, a plurality of discharge guide tubes mounted on a member located on an upper portion of the water tank and provided in corresponding relation to the vibrators for guiding out of the main body atomized water produced in the water tank by the vibrator driven by the corresponding oscillation circuit, ducts provided for the guide tubes respectively and each having one end communicating with the guide tube and the other end extending into the showcase, control means for varying the oscillation output of the oscillation circuit corresponding to at least one of the vibrators to control the amount of atomized water to be produced, and selection means for selecting whether the amount of humidification is to be made adjustable or constant, said control means being located at a position separately from the main body and the selection means being mounted on the main body.

2. A humidifier as defined in claim 1 wherein the control means is removably connected to the main body.

3. A humidifier as defined in claim 2 wherein the control means includes variable resistor means, and the selection means includes selector switch means.

4. A humidifier as defined in claim 3 wherein the variable resistor means is a variable multiple resistor capable of simultaneously varying the oscillation outputs of the oscillation circuits corresponding to at least two of the vibrators, and the selector switch means is a multiple switch capable of selecting adjustment of the amount of humidification by the variable multiple resistor.

5. A humidifier as defined in claim 3 wherein the variable resistor means is a variable multiple resistor capable of simultaneously varying the oscillation outputs of the oscillation circuits corresponding to at least two of the vibrators, and the selector switch means comprises a plurality of switches capable of selecting adjustment of the amount of humidification by the variable multiple resistor individually for each of its component resistor units.

6. A humidifier as defined in claim 3 wherein the variable resistor means comprises a plurality of variable resistors capable of individually varying the oscillation outputs of the oscillation circuits for the vibrators, and the selector switch means is a multiple switch capable of simultaneously selecting adjustment of the amount of humidification by the plurality of variable resistors.

7. A humidifier as defined in claim 3 wherein the variable resistor means comprises a plurality of variable resistors capable of individually varying the oscillation outputs of the oscillation circuits for the vibrators, and the selector switch means comprises a plurality of switches capable of individually selecting for each of the resistors adjustment of the amount of humidification by the resistor.

8. A humidifier as defined in claim 1 wherein the oscillation circuit is provided with switches for deenergizing individually a plurality of the vibrators.

* * * * *